US008261952B2

(12) United States Patent
Canfield et al.

(10) Patent No.: US 8,261,952 B2
(45) Date of Patent: Sep. 11, 2012

(54) DISPENSING DEVICE

(75) Inventors: Reiker Canfield, Crystal Lake, IL (US); Reinhard Neuhaus, Hemer (DE)

(73) Assignee: Seaquist Perfect Dispensing GmbH, Dortmund (DE)

( * ) Notice: Subject to any disclaimer, the term of this patent is extended or adjusted under 35 U.S.C. 154(b) by 706 days.

(21) Appl. No.: 12/439,736

(22) PCT Filed: Sep. 4, 2007

(86) PCT No.: PCT/EP2007/007694

§ 371 (c)(1),
(2), (4) Date: Jun. 11, 2009

(87) PCT Pub. No.: WO2008/028619

PCT Pub. Date: Mar. 13, 2008

(65) Prior Publication Data

US 2010/0108722 A1 May 6, 2010

(30) Foreign Application Priority Data

Sep. 7, 2006 (DE) ..... 10 2006 042 482

(51) Int. Cl.
*B65D 83/00* (2006.01)

(52) U.S. Cl. ..... 222/402.12; 222/380

(58) Field of Classification Search ..... 222/402.12, 222/402.1, 402.13, 402.15, 321.7, 321.9, 222/380, 387, 491, 495–497
See application file for complete search history.

(56) References Cited

U.S. PATENT DOCUMENTS

| | | | |
|---|---|---|---|
| 2,721,010 | A | 10/1955 | Meshberg |
| 2,736,930 | A | 3/1956 | Longley |
| 2,812,884 | A | 11/1957 | Ward |
| 2,837,249 | A | 6/1958 | Meshberg |
| 2,884,164 | A | 4/1959 | Kleid |
| 2,980,301 | A | 4/1961 | Gorter |
| 3,018,928 | A | 1/1962 | Meshberg |
| 3,073,489 | A | 1/1963 | Friedman |
| 3,104,785 | A | 9/1963 | Beard, Jr. |
| 3,131,834 | A | 5/1964 | Meshberg |
| 3,258,369 | A | 6/1966 | Blaich |
| 3,385,482 | A | 5/1968 | Frangos |

(Continued)

FOREIGN PATENT DOCUMENTS

| | | |
|---|---|---|
| DE | 2043415 | 9/1970 |

(Continued)

OTHER PUBLICATIONS

International Search Report prepared by the European Patent Office on Jan. 17, 2008, for International Application No. PCT/EP2007/007694.

(Continued)

*Primary Examiner* — Lien Ngo
(74) *Attorney, Agent, or Firm* — Jason H. Vick; Sheridan Ross, PC

(57) ABSTRACT

Disclosed is a device (1) for dispensing a liquid (2) without spraying as well as a use of such a dispensing device (1). In order to prevent liquid from escaping after a dispensing process, an outlet that opens towards the environment can be closed by means of a discharge valve (7). Said discharge valve (7) is provided with a valve body (9) which can be moved in accordance with the prevailing liquid pressure such that the discharge valve (7) opens when a minimum pressure is exceeded.

22 Claims, 4 Drawing Sheets

U.S. PATENT DOCUMENTS 3,507,586 A 4/1970 Gronemeyer et al.
3,511,418 A 5/1970 Venus, Jr.
3,542,253 A 11/1970 Weber et al.
3,608,830 A 9/1971 Ramella
3,672,543 A 6/1972 Roper et al.
3,698,961 A 10/1972 Niemann
3,706,393 A 12/1972 Curtis et al.
3,726,442 A 4/1973 Davidson et al.
3,795,350 A 3/1974 Shay
3,796,356 A 3/1974 Venus, Jr.
3,931,831 A 1/1976 French
3,961,725 A 6/1976 Clark
3,991,916 A 11/1976 Del Bon
4,035,303 A 7/1977 Ufferfilge
4,099,651 A 7/1978 Von Winckelmann
4,222,501 A 9/1980 Hammett et al.
4,304,749 A 12/1981 Bauer
4,352,443 A 10/1982 Libit
4,387,833 A 6/1983 Venus, Jr.
4,416,602 A 11/1983 Neumeister
4,423,829 A 1/1984 Katz
4,458,832 A * 7/1984 Corsette ..... 222/153.13
4,564,130 A 1/1986 Eulenburg
4,830,229 A 5/1989 Ball
4,867,347 A 9/1989 Wass et al.
4,875,604 A 10/1989 Czech
4,892,231 A 1/1990 Ball
4,919,312 A 4/1990 Beard et al.
4,969,577 A 11/1990 Werding
5,007,556 A 4/1991 Lover
5,007,596 A 4/1991 Iwahashi
5,096,098 A 3/1992 Garcia
5,197,637 A 3/1993 Naumann
5,221,724 A 6/1993 Li et al.
5,271,432 A 12/1993 Gueret
5,301,850 A 4/1994 Gueret
5,360,145 A 11/1994 Gueret
5,413,250 A 5/1995 Gueret
5,454,488 A 10/1995 Geier
5,465,872 A 11/1995 Gueret
5,492,252 A 2/1996 Gueret
5,505,341 A 4/1996 Gueret
5,509,582 A 4/1996 Robbins, III
5,687,884 A * 11/1997 Bodin et al. ..... 222/321.7
5,728,333 A 3/1998 Tabata et al.
5,732,855 A 3/1998 Van der Heijden
5,743,441 A 4/1998 Baudin et al.
5,769,283 A 6/1998 Owada et al.
5,857,224 A 1/1999 Oberg et al.
5,862,955 A 1/1999 Albini et al.
5,868,287 A 2/1999 Kurolkawa et al.
5,873,491 A 2/1999 Garcia et al.
5,875,936 A 3/1999 Turbett et al.
5,875,939 A 3/1999 Geier
5,881,929 A 3/1999 Coerver, Jr.
5,927,568 A 7/1999 De Nervo et al.
5,975,381 A 11/1999 Revenu
6,007,914 A 12/1999 Joseph et al.
6,083,450 A 7/2000 Safian
6,112,953 A 9/2000 Gueret
6,116,475 A * 9/2000 Delage ..... 222/494
6,145,707 A 11/2000 Baudin
6,216,916 B1 4/2001 Maddox et al.
6,298,960 B1 10/2001 Derr
6,322,542 B1 11/2001 Nilson et al.
6,328,920 B1 12/2001 Uchiyama et al.
6,352,184 B1 3/2002 Stern et al.
6,756,004 B2 6/2004 Davis et al.
6,778,089 B2 8/2004 Yoakum
6,832,704 B2 12/2004 Smith
6,919,114 B1 7/2005 Darras et al.
6,966,465 B2 * 11/2005 Kang ..... 222/321.9
7,780,045 B2 * 8/2010 Rossignol ..... 222/322
7,854,355 B2 * 12/2010 Rossignol ..... 222/380
2002/0037179 A1 3/2002 Suzuki et al.
2002/0051314 A1 5/2002 Hayashi
2002/0074355 A1 6/2002 Lewis et al.
2002/0190085 A1 12/2002 Stanford
2003/0071080 A1 4/2003 Yquel
2003/0230603 A1 12/2003 Smith
2005/0155980 A1 7/2005 Neuhalfen
2006/0060618 A1 3/2006 Hoepner et al.
2006/0231519 A1 10/2006 Py et al.
2007/0228082 A1 10/2007 Jasper et al.
2007/0272767 A1 11/2007 Niggemann
2008/0110941 A1 5/2008 Foster et al.
2008/0197152 A1 8/2008 Neuhaus et al.
2009/0166383 A1 7/2009 Canfield
2009/0212075 A1 8/2009 Neuhaus et al.
2009/0294480 A1 12/2009 Canfield
2009/0314810 A1 12/2009 Neuhaus
2010/0012680 A1 1/2010 Canfield et al.
2010/0038385 A1 2/2010 Jasper
2010/0147898 A1 6/2010 Blumenstein et al.

FOREIGN PATENT DOCUMENTS

DE 2920497 11/1980
DE 9307083 7/1993
DE 4210225 A1 9/1993
DE 19851659 11/1998
DE 29820894 1/1999
DE 19744510 4/1999
DE 19832824 2/2000
DE 19950512 5/2001
DE 20203841 U1 6/2002
DE 10308727 6/2004
DE 202004011219 11/2004
DE 202004011220 11/2004
DE 20200512684 11/2005
EP 0058700 9/1982
EP 0069738 1/1983
EP 0179538 4/1986
EP 0320510 6/1989
EP 0442858 8/1991
EP 0599301 6/1994
EP 0864371 A 9/1998
EP 0893356 1/1999
EP 0908395 4/1999
EP 0930102 7/1999
EP 1084669 3/2001
EP 1327478 A 7/2003
EP 1637232 3/2006
FR 1266391 7/1961
FR 2127774 10/1972
FR 2510069 1/1983
FR 2654079 11/1989
FR 2783667 3/2000
FR 2838108 10/2003
GB 1405546 8/1972
GB 1523732 9/1978
GB 2083142 3/1982
GB 2105729 3/1983
GB 2150226 6/1985
GB 2155435 9/1985
GB 2161222 1/1986
JP 07251884 3/1995
JP 09039467 2/1997
WO WO 96/16746 6/1996
WO WO 00/26007 5/2000
WO WO 00/44505 8/2000
WO WO 01/25116 4/2001
WO WO 02/079679 10/2002
WO WO 2004/022143 3/2004
WO WO 2004/073871 9/2004
WO WO 2004/073877 9/2004
WO WO 2005/000731 1/2005
WO WO 2005/123542 12/2005
WO WO 2005/123543 12/2005
WO WO 2006/123168 11/2006
WO WO2006128574 A 12/2006
WO WO 2007/062824 6/2007
WO WO 2007/104561 9/2007
WO WO 2009/030393 3/2009

OTHER PUBLICATIONS

U.S. Appl. No. 12/303,807, filed Apr. 1, 2010, Neuhaus et al.

U.S. Appl. No. 12/600,219, filed Mar. 13, 2010, Canfield et al.

U.S. Appl. No. 12/675,204, filed Apr. 29, 2010, Sonntag.

U.S. Appl. No. 12/675,229, filed Apr. 27, 2010, Bernhard.

Wacker Silicones, Geniomer® 200 Thermoplastic Silicone Elastomer, Jan. 10, 2005, XP002394023, retrieved from Internet address http://www.wacker.com/internet/webcache/en_US?PTM?TM?GENIOMER/GENIOMER_200_e.pdf on Aug. 8, 2006.

* cited by examiner

DISPENSING DEVICE

CROSS REFERENCE TO RELATED APPLICATIONS

This application is a national stage application under 35 U.S.C. 371 of PCT Application No. PCT/EP2007/007694 having an international filing date of 4 Sep. 2007, which designated the United States, which PCT application claimed the benefit of German Application No. 10 2006 042 482.4 filed 7 Sep. 2006, the entire disclosure of each of which are hereby incorporated herein by reference.

The present invention relates to a dispensing device as well as the use of dispensing device according to the claims appended hereto.

In the present invention, the term "dispensing device" is to be particularly understood as a dispensing head which, preferably, is or can be mounted particularly on a container or the delivery valve thereof or on a hand-operated pump. Particularly, this can also be a pressurized container, a dispensing pump, or the like. The dispensing device is used for the non-spraying delivery or dispensing of a preferably cosmetic liquid.

The term "cosmetic liquid" is to be understood, in a narrower sense, as cosmetics, hair spray, hair lacquer, a deodorant, a foam, particularly shaving foam, a gel, a color spray, a sun protection or skin care agent or the like. Preferably, however, in a broader sense, other body care products, cleaning products or the like, and even suspensions and fluids, particularly those with gas phases, are included as well. Moreover, other liquids, for example air improvers and particularly technical liquids and fluids as well such as rust removers and the like, can also be used. Nonetheless, for the sake of simplicity and due to the emphasized use, there is often only mention of cosmetic liquid in the following.

In today's dispensing devices for the dispensing of, particularly, foaming or foamed liquids such as shaving foam, or in dispensing pumps, there is often the problem that the liquids come out after the actual dispensing is finished, in particular foaming or dripping out afterwards. This problem is particularly blatant in shaving foam or the like but also occurs in non-foamed or non-foaming liquids and can lead, in particular, to undesired contaminations of the dispensing devices.

It is the object of the present invention to propose a dispensing device and a use which prevent or minimize a subsequent escape of liquid, particularly a subsequent foaming.

The above object is achieved by a dispensing device according to the claims appended hereto. Advantageous modifications are the object of the subclaims.

One aspect of the present invention consists in that an outlet channel has an outlet opening which can be sealed by the outlet valve and opens to the outside or is arranged downstream, which is to say on the outlet side. The outlet valve is therefore arranged downstream or on the outlet side. In this manner, liquid can be prevented from coming out afterwards, i.e. after the closing of the dispensing device. Particularly, a subsequent foaming that occurs in a particularly pronounced manner in the case of shaving foam or the like can be prevented.

The dispensing device is used for a non-spraying dispensing of the liquid. Particularly, therefore, no atomization or spraying occurs, but rather preferably a relatively slow dispensing at an at least relatively slow dispensing speed. Therefore, the liquid is particularly not delivered as a stream.

The liquid is especially preferably foamed up or is designed to be self-foaming. Especially preferably, it is shaving foam or the like. However, the liquid to be delivered or the delivered liquid can also have a relatively high viscosity and/or even be delivered in paste-like form.

Another aspect of the present invention consists in that the outlet valve has a valve body which can be moved in a manner dependent on the corresponding liquid pressure so that the outlet valve opens upon overshooting of a minimum pressure. In this manner, the dispensing of liquid always only occurs when dispensing is in fact desired, which is to say when the corresponding liquid pressure is relatively high. At the same time, undesired dispensing of liquid can be prevented in this manner.

In a liquid which foams up, for example, upon contact with the air, the minimum pressure is preferably higher than the foaming pressure and/or the liquid is locked in an air-tight fashion in the outlet channel in order to prevent the undesired subsequent foaming from the outlet or through the outlet opening.

Further advantages, features, characteristics and aspects of the present invention follow from the claims and the following description of preferred embodiments on the basis of the drawing.

In the figures, which are not to scale and only schematic, the same reference symbols are used for the same or similar parts, with corresponding or comparable characteristics and advantages being achieved even if a repeated description has been omitted.

FIG. 1 shows in schematic section a proposed dispensing device 1 which is embodied here as a dispensing head for the dispensing of a liquid 2 in the sense named at the outset.

Figure 1:
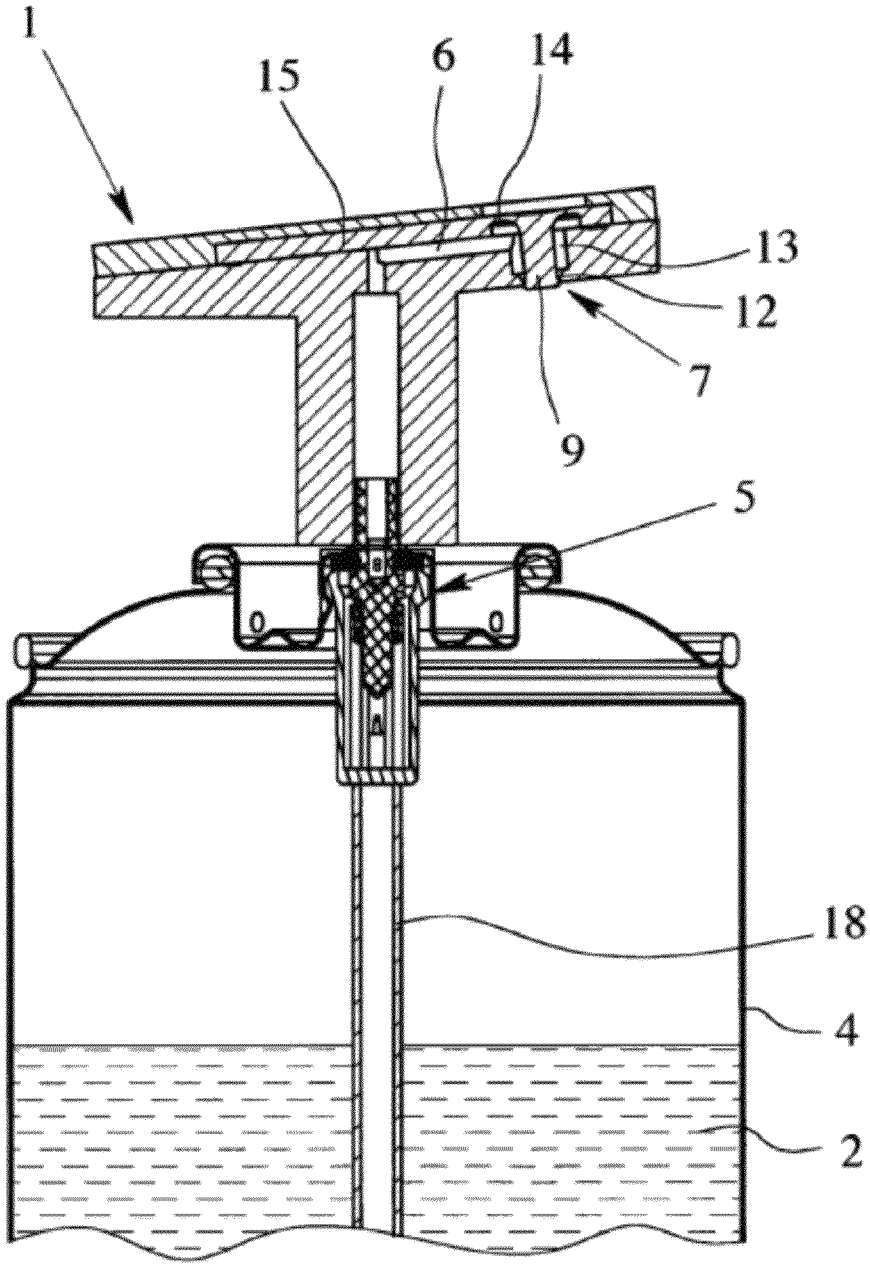
FIG. 1 shows a schematic section of a proposed dispensing device according to a first embodiment.

Particularly, the dispensing device 1 is designed for the non-spraying dispensing of the liquid 2. Particularly, a delivery occurs of the liquid 2 as a foam 3, preferably as a shaving foam or the like, as indicated schematically in FIG. 2. For this purpose, the liquid 2 is particularly designed to be self-foaming and/or is foamed up upon dispensing.

However, in principle, the liquid 2 can also be dispensed in the non-foamed state and, particularly, can also be non-foaming. Particularly, a lotion can also be output as the liquid 2. Moreover, it is also possible for the liquid to foam up only a slight amount, so that the foaming only enlarges the volume somewhat, for example, but a liquid or pasty consistency is essentially maintained during dispensing.

The dispensing device is preferably provided with or connected to a reservoir 4 for the liquid 2 to be delivered. The reservoir 4 can thus form part of the dispensing device 1 or can be connected to same.

In the first embodiment, the reservoir 4 is embodied as a preferably rigid container, preferably as a pressurized container.

The liquid 2 in the reservoir 4 can either be placed under pressure or is under pressure. Particularly, the container or the liquid 2 contains a suitable propellant, preferably a volatile and/or flammable propellant, compressed gas and/or carbon dioxide.

In the first embodiment, the container is particularly oblong and/or cylindrical and/or rigid—especially preferably in the manner of a metallic can—for the liquid 2 and especially preferably has a dispensing valve 5 on the face side to which the dispensing device 1 or the dispensing head formed thereby is connected.

Figure 2:
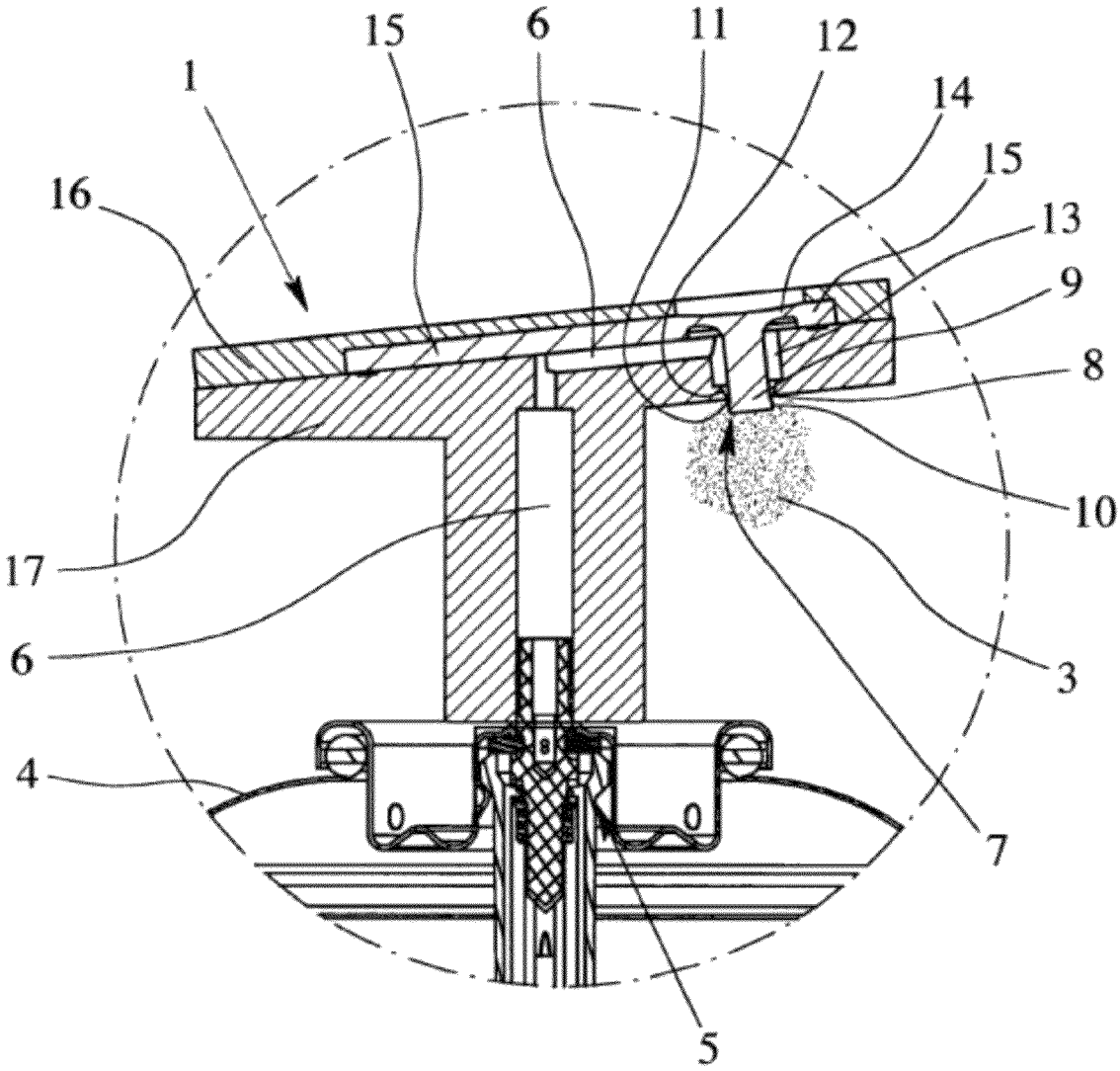
FIG. 2 shows an enlarged section of FIG. 1 with opened outlet valve.

FIG. 2 shows, in sectional enlargement of FIG. 1, the dispensing device 1 or the dispensing head formed thereby more clearly with opened outlet valve 2 with output foam 3 but without liquid 2 in the outlet channel 6.

The dispensing device 1 has an outlet 6 and an associated outlet valve 7. The outlet channel 6 has an outlet opening 8 which preferably opens to the outside or is arranged downstream. The term "opens to the outside" means, in particular, that there is no adjacent nozzle [and] no additional channel or the like. Rather, after emerging from the outlet opening 8, the liquid 2 can be preferably directly removed or used by the user (not shown).

The outlet valve 7 is preferably associated with the outlet opening 8, so that it can be sealed by the outlet valve 7.

The outlet valve 7 preferably has a valve body 9 which can be moved in a manner dependent on the corresponding liquid pressure, so that the outlet valve 7 opens upon overshooting of a minimum pressure, preferably exclusively as a result of the liquid pressure.

Especially preferably, this minimum pressure is higher than the foaming pressure of the self-foaming liquid 2. By contrast, the delivery pressure (with opened dispensing valve 5) and hence the imminent liquid pressure is then in turn higher than the minimum pressure, so that the outlet valve 7 then opens for the desired dispensing of liquid and generation or delivery of the foam 3.

In the first embodiment, the opening of the dispensing valve 5 preferably occurs by pressing down on the dispensing device 1 or the dispensing head formed thereby. The dispensing valve 5 then closes again automatically upon release. However, the dispensing valve 5 can also be a dosing valve or the like, for example.

The valve body 9 is preferably substantially cylindrical, as indicated particularly in FIG. 2. The valve body 9 preferably has a collar or, particularly, a substantially conical sealing section 10 which, when the outlet valve 7 is closed, works together in a sealing manner with a valve seat 11 of the outlet valve 7, which is particularly formed by the outlet opening 8 or is arranged in immediate proximity thereto. As needed, the valve seat 11 can also be formed by a section 12 of the outlet channel 6 adjacent to the outlet opening 8.

In the depicted example, the dispensing device 1 or the outlet channel 6 preferably has a ring channel 13 enclosing the valve body 9 to which ring channel 13 the outlet channel section 12, which is tapered or reduced in cross-section, connects with the outlet opening 8.

The valve body 9 is preferably composed of an elastic material, especially preferably an elastomer or polymer. In the depicted example, the valve body 9 is injection molded.

In the depicted example, the valve body 9 is preferably held in a preferably axially moveable manner by an elastically deformable, particularly annular retention section 14. Especially preferably, the valve body 9 is embodied in a single piece with the retention section 14 or formed thereon.

The valve body 9 is preferably held by the retention section 14 and/or a mounting section 15. In the depicted example, the mounting section 15 is adjacent to the retention section 14, which is preferably reduced in thickness, and/or encloses same. Especially preferably, the mounting section 15 is mounted on the dispensing device 1, particularly solidly mounted with a component 16, such as an upper part, of the dispensing device 1. Especially preferably, the mounting section 15 is injection molded or formed onto the dispensing device 1 or its component 16. Especially preferably, so-called "bi-injection" is performed, which is to say an injection of another material in the same injection mold in which a first material is molded.

In the depicted example, the mounting section 15, the retention section 14 and the valve body 9 are particularly embodied in a single piece and/or manufactured from the same, preferably elastic material, particularly plastic, especially preferably by means of so-called "bi-injection." However, there are other constructive and/or technical manufacturing solutions here as well.

In the depicted example, the dispensing device 1 has a lower part 17 which is or can be connected with the reservoir 4 or dispensing valve 5 and/or which forms the outlet channel 6 (optionally together with the component 16 or mounting section 15), the outlet opening 8 and/or the valve seat 11. In the depicted example, the component 16 forming an upper part can be or is connected with the lower part 17 such that the outlet channel 6 is covered or sealed off particularly tightly—preferably in a gas- or air-tight manner. Together with the outlet valve 7, which preferably closes in an air-tight manner, this offers the advantage that after the first use of the dispensing device 1, liquid 2 remaining in the outlet channel 6 is not subjected to the effect of air or other external influences or preferably at least only to a negligible extent—even in the case of extended storage or non-use of the dispensing device 1. Particularly, in this manner, an automatically foaming liquid 2 such as that commonly used for shaving foam can be prevented from foaming up in the outlet channel 6 and exiting or gushing out in an undesired manner from the dispensing device 1, particularly over an extended period of time.

To be used, the dispensing device 1 or the dispensing head preferably formed thereby is pressed down or otherwise actuated—preferably directly and/or manually—so that the dispensing valve 5 opens. The preferably pressurized liquid 2 in the reservoir or container 4 can then flow into the outlet channel 6 via a riser tube 18 and the opened dispensing valve 5. As a result of the liquid pressure or dispensing pressure then prevailing or present in the outlet channel 6, the outlet valve 7 opens. In the first embodiment, this occurs as a result of the valve body 9 moving out of the outlet opening 8 or outwardly, wherein the retention section 14 is accordingly elastically deformed. The liquid 2 is then able to escape through the opened outlet valve 7 or the outlet opening 8 toward the outside or into the open and especially preferably foam up and form the foam 3. FIG. 2 shows the dispensing device 1 with opened outlet valve 7 with the foam 3 preferably formed from the dispensed liquid 2 in the area of the outlet opening 8. The dispensed liquid 2 or the foam 3 can then be particularly manually removed, in particular wiped off, by a user (not shown).

The dispensing of liquid ends when the liquid pressure or the dispensing pressure prevailing in the outlet channel 6 falls again below the minimum pressure, so that the outlet valve 7 closes. This is the case when the dispensing valve 5 closes again—particularly through the releasing or the automatic return to position of the dispensing head. The closed or closing outlet valve 7 then prevents the liquid 2 still located in the outlet channel 6 from subsequently coming or foaming out of the outlet opening 8 in an undesired manner.

In the depicted example, the closing of the outlet valve 7 preferably occurs exclusively as a result of elastic restorative forces of the retention section 14. In addition or alternatively, a return or closing spring (not shown) can also be attached to the valve body 9 in order to close the outlet valve 7.

To promote the closing of the outlet valve 7, a certain pressure compensation can be provided. In the depicted example, the liquid pressure present in the ring channel 13 acts on the retention section 14 in the closing direction. The pressure compensation, the restorative forces and the closing behavior of the outlet valve 7 depend particularly on the surface ratios (the surface of the retention section 14 to the cross-section of the valve body 9 in the area of attachment to the valve seat 11) and on the size and characteristic of the retention section 14.

A special advantage of the proposed solution is that, besides preventing the subsequent emergence of liquid 2, particularly subsequent foaming, very simple cleaning is made possible for the user as well, since the outlet valve 7 preferably seals the outlet opening 8 directly, so that a clean or easy-to-clean seal or liquid outlet is formed in the closed state.

In the depicted example, the delivery of liquid occurs substantially counter to the direction of depression or direction of opening of the dispensing valve 5 and/or at least substantially downward or in the longitudinal direction or axial direction of the especially preferably substantially cylindrical reservoir or container 4. In principle, however, the delivery direction can occur in any direction, particularly even substantially horizontally and/or laterally or radially.

Another aspect of the illustrative example is that the valve body 9 can preferably be moved in or opposite from the delivery direction of the liquid 2 and/or in the outlet opening 8.

Moreover, it should be pointed out that, preferably, no further device shaping the dispensing such as a nozzle, a channel or the like is connected to the outlet opening 8. However, this does not rule out that a saucer-like extension, a recess in the housing or the like into which the outlet opening 8 leads can be provided.

It should be noted that, in principle, instead of the dispensing of the liquid 2 depicted for the sake of example as foam 3, any other delivery of the liquid 2 is possible—if necessary even as a paste-like mass, as a gel, as drops or even as a stream or spray mist.

Figure 3:
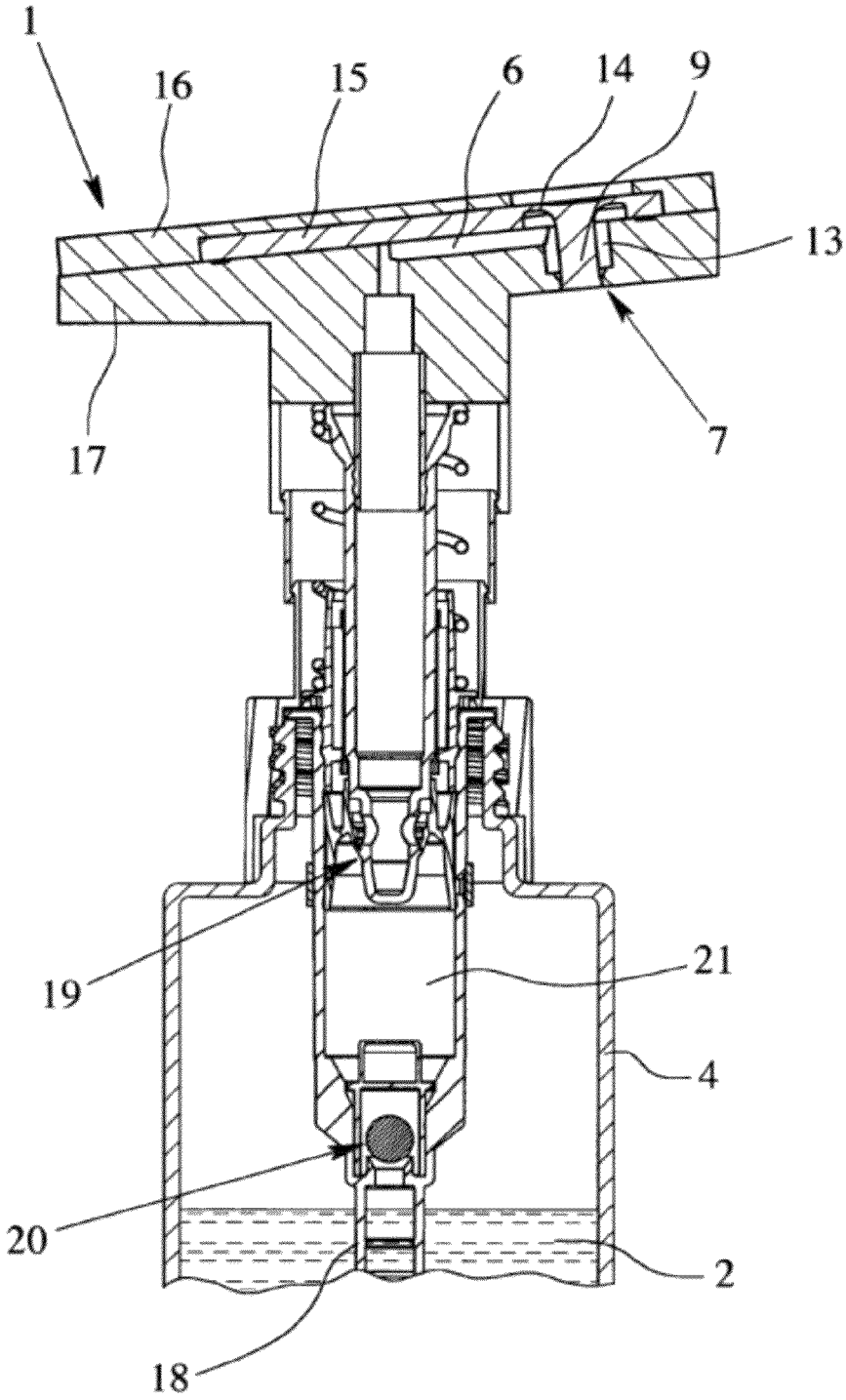
FIG. 3 shows a schematic section of a proposed dispensing device according to a second embodiment.

In the following, another embodiment is explained in further detail on the basis of FIGS. 3 and 4, which correspond to FIGS. 1 and 2, with only substantial differences with respect to the first embodiment being dealt with. The foregoing remarks and explanations therefore apply particularly in addition or correspondingly.

In the second embodiment, the liquid 2 does not foam or is not foamed up.

In the second embodiment, the dispensing device 1 is provided with a preferably manually operable pump 19, particularly a dosing or dispensing pump, or is connected thereto. By pressing down on the dispensing head formed by the dispensing device 1, the liquid 2 is conveyed into the dosing channel and a dispensing pressure is generated which is such that the outlet valve 7 opens and the liquid 2 is dispensed via the outlet opening 8. Upon release of the dispensing head, a preferably automatic return to position occurs, with the dispensing valve 5 of the pump 19 closing and an inlet valve 20 opening during the restorative movement in order to suck new liquid 2 from the reservoir 5 into a pump chamber 21 of the pump 19.

In the second embodiment, the outlet valve 7 particularly prevents an undesired subsequent dripping of liquid 2 from the outlet channel 6 or out of the outlet opening 8.

Figure 4:
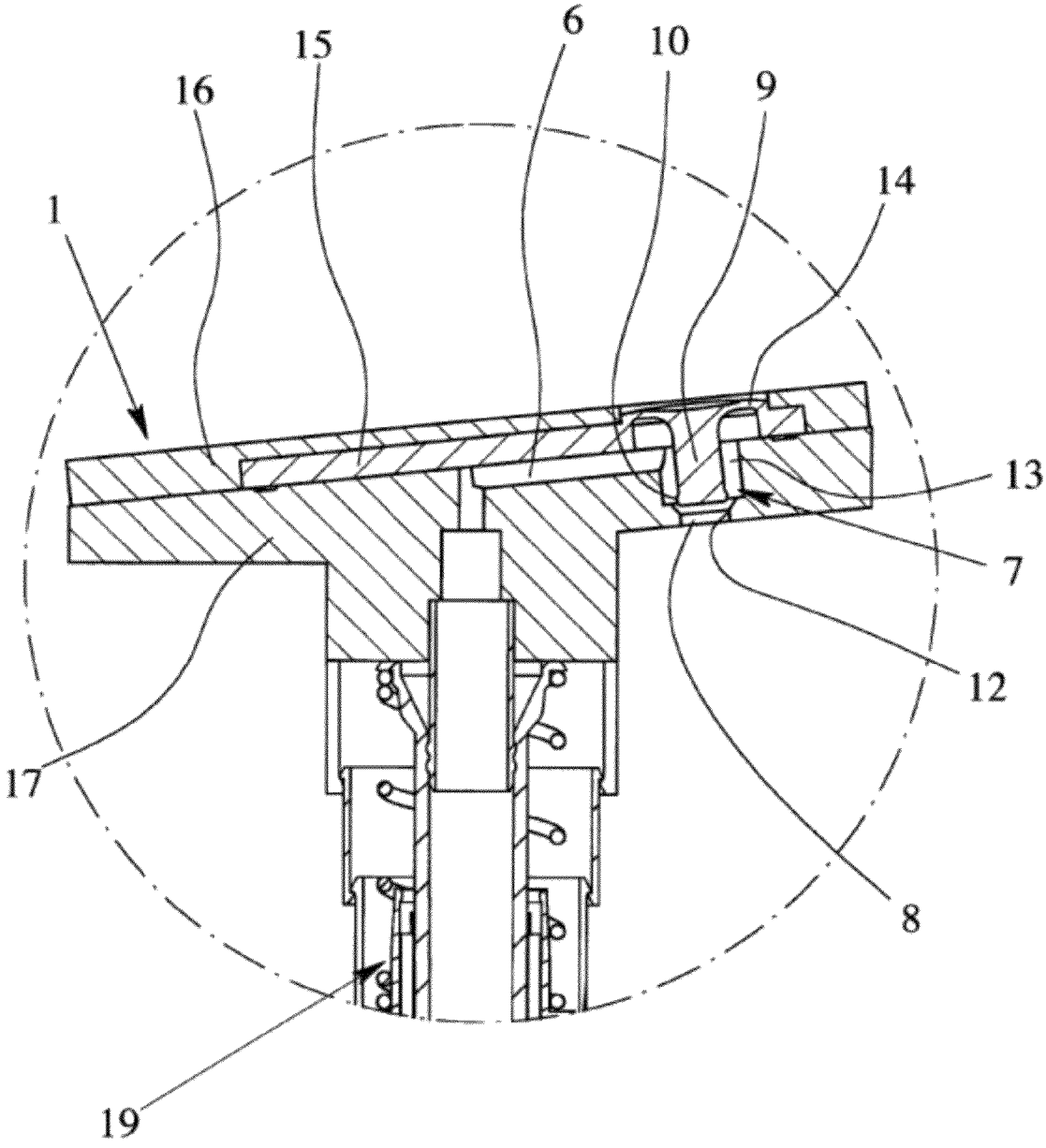
FIG. 4 shows an enlarged section of FIG. 3 with opened outlet valve.

In the second embodiment, the outlet valve 7 is embodied such that, upon opening, the valve body 9 retreats into the outlet opening 8 or into the upstream-connected section 12 of the outlet channel 6 as indicated in FIG. 4. Particularly, a substantially radial seal is formed when the outlet valve 7 is closed between the valve body 9 or the ring collar thereof or sealing section 10 on the one hand and the outlet channel section 12 or valve seat 11 on the other hand (see FIG. 3).

The valve body 9 ends—particularly when the outlet valve 7 is closed—at least substantially at the level of the outlet opening 8. This applies particularly to the first embodiment as well.

Alternatively, the valve body 9 can also protrude over the outlet opening 8 toward the outside; this applies particularly in the first embodiment, especially preferably when the outlet valve 7 is open but, if necessary, also when the outlet valve 7 is closed.

Individual features and aspects of the various embodiments can be combined with each other as desired or used in other dispensing devices or the like.

LIST OF REFERENCE SYMBOLS

1 dispensing device
2 liquid
3 foam
4 reservoir
5 dispensing valve
6 outlet channel
7 outlet valve
8 outlet opening
9 valve body
10 sealing section
11 valve seat
12 outlet channel section
13 ring channel
14 retention section
15 mounting section
16 component
17 lower part
18 riser tube
19 pump
20 inlet valve
21 pump chamber

The invention claimed is:

1. Dispensing device for the non-spraying dispensing of a liquid, with an outlet channel and an associated outlet valve, wherein the outlet channel has an outlet opening which opens to the outside or is arranged downstream and can be sealed by the outlet valve, and wherein the outlet valve has a valve body which can be moved in a manner dependent on the corresponding liquid pressure, so that the outlet valve opens upon overshooting of a minimum pressure, wherein the valve body is held by means of an elastically deformable retention section, and wherein, upon opening the outlet valve, the valve body retreats into the outlet opening or into a section of the outlet channel adjacent upstream of the outlet opening.

2. Dispensing device as set forth in claim 1, wherein the dispensing device is embodied as a dispensing head or has a dispensing head.

3. Dispensing device as set forth in claim 1, wherein the dispensing device is or can be connected to a reservoir or container that is or can be pressurized, with the liquid or is provided therewith.

4. Dispensing device as set forth in claim 1, wherein the dispensing device is connected to a dispensing valve, which can be opened by pressing.

5. Dispensing device as set forth in claim 1, wherein the dispensing device is or can be connected to a manually operable pump for conveying the liquid or is provided with the manually operable pump.

6. Dispensing device as set forth in claim 5, wherein the pump is operated through depression.

7. Dispensing device as set forth in claim 1, wherein the liquid is dispensed as a foam or a shaving foam.

8. Dispensing device as set forth in claim 1, wherein the minimum pressure of the outlet valve is higher than a foaming pressure of a self-foaming liquid.

9. Dispensing device as set forth in claim 1, wherein the dispensing device has an upper part with the valve body, with the upper part being embodied in a single piece or being manufactured by means of bi-injection.

10. Dispensing device as set forth in claim 1, wherein, when the outlet valve is closed, the valve body ends at least substantially at the level of the outlet opening.

11. Dispensing device as set forth in claim 1, wherein the valve body protrudes over the outlet opening toward the outside.

12. Dispensing device as set forth in claim 1, wherein the outlet opening or a section of the outlet channel adjacent thereto forms a valve seat of the outlet valve or for the valve body.

13. Dispensing device as set forth in claim 1, wherein the valve body is substantially cylindrical.

14. Dispensing device as set forth in claim 1, wherein the valve body has a ring collar or a substantially conical sealing section, which acts in a sealing manner together with a valve seat of the outlet valve when the outlet valve is closed.

15. Dispensing device as set forth in claim 1, wherein the valve body is made of elastic material.

16. Dispensing device as set forth in claim 1, wherein the valve body is injection molded.

17. Dispensing device as set forth in claim 1, wherein the valve body is embodied in a single piece with the retention section or is formed thereon.

18. Dispensing device as set forth in claim 1, wherein the valve body is held by means of the retention section and is injection molded together in one piece with the valve body and with a mounting section formed onto a component of the dispensing device.

19. Dispensing device as set force in claim 13, wherein the valve body is moveable along its longitudinal axis in the outlet channel.

20. Dispensing device as set force in claim 1, wherein the retention section is annular.

21. Dispensing device as set force in claim 1, wherein the retention section forms an elastically deflectable membrane.

22. Dispensing device as set force in claim 13, wherein the retention section extends in radial direction of the valve body.

* * * * *